US009078497B2

(12) United States Patent
Ma

(10) Patent No.: US 9,078,497 B2
(45) Date of Patent: Jul. 14, 2015

(54) QUICK CONNECTOR HUB FOR SHADE STRUCTURE

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 13/787,601

(22) Filed: Mar. 6, 2013

(65) Prior Publication Data

US 2014/0251394 A1 Sep. 11, 2014

(51) Int. Cl.

| | |
|---|---|
| ***A45B 25/10*** | (2006.01) |
| ***A45B 25/06*** | (2006.01) |
| ***A45B 25/08*** | (2006.01) |
| *E04B 1/32* | (2006.01) |

(52) U.S. Cl.

CPC ..... *A45B 25/10* (2013.01); *A45B 25/06* (2013.01); *A45B 25/08* (2013.01); *E04B 2001/3247* (2013.01)

(58) Field of Classification Search

CPC ..... A45B 25/06; A45B 25/10; E04H 15/28; E04H 15/44; E04H 15/48; A63H 33/06; A63H 33/08; E04B 1/32; E04B 7/105; E04B 7/08; E04B 2001/3247; E04C 3/02

USPC ..... 135/28–30, 98, 135, 147, 156, 159, 135/120.3; 403/170–173, 217–219; 446/102, 126, 128; 52/81.2, 81.3, 109, 52/645–646, 648.1, 656.1, 656.9

See application file for complete search history.

(56) References Cited

U.S. PATENT DOCUMENTS

| | | | |
|---|---|---|---|
| 331,231 | A | 11/1885 | Folger |
| 501,089 | A | 7/1893 | Lichtenstein |
| 620,815 | A | 3/1899 | Warren |
| 770,704 | A | 9/1904 | Bishop |
| 880,534 | A | 3/1908 | Hoyt |
| 897,026 | A | 8/1908 | Seitzinger |
| 928,169 | A | 7/1909 | Bardon |
| 941,952 | A | 11/1909 | Riehl |
| 947,790 | A | 2/1910 | Carter |
| 959,127 | A | 5/1910 | Edwards |
| 1,001,076 | A | 8/1911 | Redford |
| 1,078,069 | A | 11/1913 | Simons |
| 1,107,415 | A | 8/1914 | Drohan |
| 1,264,075 | A | 4/1918 | Hout |

(Continued)

FOREIGN PATENT DOCUMENTS

| | | |
|---|---|---|
| CA | 1269018 | 5/1990 |
| EP | 0202769 | 12/1989 |

(Continued)

OTHER PUBLICATIONS

U.S. Appl. No. 13/783,958 and its prosecution history, Mar. 4, 2013, Ma.

(Continued)

*Primary Examiner* — Winnie Yip

(74) *Attorney, Agent, or Firm* — Knobbe Martens Olson & Bear, LLP

(57) ABSTRACT

An umbrella hub is provided that includes a hub body and a plurality of slots. The hub body extends between an outer periphery and a central aperture configured to receive an umbrella pole. The slots comprise a pivot zone configured to receive and retain a mounting pin of an umbrella rib or strut. The hub can be loaded in a generally horizontal direction. Deflectable surfaces enable rigid pins of the umbrella rib or strut to be engaged with the hub for pivoting therein.

18 Claims, 11 Drawing Sheets

(56) References Cited

U.S. PATENT DOCUMENTS

| | | | | |
|---|---|---|---|---|
| 1,469,495 | A | 10/1923 | Bunker | |
| 2,207,043 | A | 7/1940 | Weiss et al. | |
| 2,321,495 | A | 6/1943 | Levin | |
| 2,336,116 | A | 12/1943 | Morando | |
| 2,385,575 | A | 9/1945 | Isler | |
| 2,469,637 | A | 5/1949 | Evans et al. | |
| 2,635,616 | A | 4/1953 | Haydu | |
| 2,762,383 | A | 9/1956 | Wittman | |
| 2,796,073 | A | 6/1957 | Wittman | |
| 2,860,647 | A | 11/1958 | Negri | |
| 2,914,154 | A | 11/1959 | Russell | |
| 3,177,882 | A | 4/1965 | Vincent | |
| 3,424,180 | A | 4/1966 | Andolfi | |
| 3,330,582 | A | 7/1967 | Morris | |
| 3,462,179 | A | 8/1969 | Hinkle | |
| 3,557,809 | A | 1/1971 | Vazquez et al. | |
| 3,643,673 | A | 2/1972 | Weber | |
| 3,704,479 | A | 12/1972 | Whitaker | |
| 4,201,237 | A | 5/1980 | Watts et al. | |
| 4,368,749 | A | 1/1983 | Lindler et al. | |
| 4,369,000 | A | 1/1983 | Egnew | |
| 4,627,210 | A | 12/1986 | Beaulieu | |
| 4,673,308 | A | 6/1987 | Reilly | |
| 4,750,509 | A | 6/1988 | Kim | |
| 4,941,499 | A * | 7/1990 | Pelsue et al. | 135/125 |
| D320,111 | S | 9/1991 | Ma | |
| 5,056,291 | A | 10/1991 | Leung | |
| 5,069,572 | A * | 12/1991 | Niksic | 403/170 |
| 5,085,239 | A | 2/1992 | Chin-Hung et al. | |
| 5,188,137 | A | 2/1993 | Simonelli | |
| 5,193,566 | A | 3/1993 | Chen | |
| 5,328,286 | A | 7/1994 | Lee | |
| 5,433,233 | A | 7/1995 | Shiran et al. | |
| 5,445,471 | A | 8/1995 | Wexler et al. | |
| 5,738,129 | A | 4/1998 | Vogt | |
| 5,740,824 | A | 4/1998 | Tang | |
| 5,797,613 | A | 8/1998 | Busby | |
| 5,797,695 | A * | 8/1998 | Prusmack | 403/170 |
| 5,911,233 | A | 6/1999 | Wu | |
| 6,076,540 | A | 6/2000 | You | |
| 6,095,169 | A | 8/2000 | Lin et al. | |
| 6,311,706 | B1 | 11/2001 | Sato | |
| 6,314,976 | B1 | 11/2001 | Clarke | |
| 6,332,657 | B1 | 12/2001 | Fischer | |
| 6,345,637 | B1 | 2/2002 | Ko | |
| 6,354,316 | B1 * | 3/2002 | Chen | 135/100 |
| 6,374,840 | B1 | 4/2002 | Ma | |
| 6,386,215 | B1 | 5/2002 | Chang | |
| 6,397,867 | B2 | 6/2002 | You | |
| 6,604,844 | B2 * | 8/2003 | Hussey | 362/341 |
| 6,643,889 | B1 | 11/2003 | Kotlarski | |
| 6,701,946 | B2 | 3/2004 | You | |
| 6,705,335 | B2 | 3/2004 | You | |
| 6,758,228 | B1 | 7/2004 | You | |
| 6,814,093 | B2 | 11/2004 | You | |
| 7,178,535 | B2 * | 2/2007 | Eder | 135/28 |
| 7,464,503 | B2 * | 12/2008 | Hoberman | 52/81.1 |
| 7,481,235 | B2 * | 1/2009 | Prusmack | 135/135 |
| 7,574,777 | B1 | 8/2009 | Fuller et al. | |
| 7,703,464 | B2 | 4/2010 | Ma | |
| 7,891,367 | B2 * | 2/2011 | Ma | 135/19.5 |
| 8,061,375 | B2 | 11/2011 | Ma | |
| 8,069,872 | B2 * | 12/2011 | Bae | 135/147 |
| 8,082,935 | B2 | 12/2011 | Ma | |
| 8,166,986 | B2 | 5/2012 | Ma | |
| 8,485,208 | B2 * | 7/2013 | Seo | 135/135 |
| 2004/0123891 | A1 | 7/2004 | Ma | |
| 2005/0115599 | A1 | 6/2005 | You | |
| 2006/0124160 | A1 | 6/2006 | Lee | |
| 2007/0172310 | A1 | 7/2007 | Yang et al. | |
| 2009/0126769 | A1 | 5/2009 | Hoogendoorn | |
| 2009/0260664 | A1 | 10/2009 | Ma | |
| 2011/0017249 | A1 | 1/2011 | Ma | |
| 2012/0318316 | A1 | 12/2012 | Choi et al. | |
| 2013/0276843 | A1 | 10/2013 | Ma | |
| 2014/0246062 | A1 | 9/2014 | Ma | |

FOREIGN PATENT DOCUMENTS

| | | |
|---|---|---|
| FR | 855628 | 5/1940 |
| FR | 002650491 | 2/1991 |
| FR | 2857835 | 1/2005 |
| GB | 2113543 | 8/1983 |
| JP | 61131921 | 8/1986 |
| KR | 100851744 | 8/2008 |
| WO | WO 2005/023042 | 3/2005 |

OTHER PUBLICATIONS

U.S. Appl. No. 14/189,822 and its prosecution history, Feb. 25, 2014, Ma.

EPO Extended Search Report dated Apr. 5, 2011 for European Patent No. 09252140.0, filed Sep. 7, 2009.

Treasure Garden, 2010 Products Catalog, pp. 20 and 60.

Extended European Search Report dated Jul. 7, 2014 for EP Application No. 14157685, filed Mar. 4, 2014, in 8 pages.

Extended European Search Report dated Jul. 7, 2014 for EP Application No. 14158057, filed Mar. 6, 2014, in 7 pages.

* cited by examiner

QUICK CONNECTOR HUB FOR SHADE STRUCTURE

BACKGROUND OF THE INVENTION

1. Field of the Invention

This application relates to apparatuses and methods that facilitate efficient assembly of ribs and hubs of umbrellas and other structures with a plurality of arms that extend from a central hub member.

2. Description of the Related Art

Large umbrellas, such as market umbrellas, generally include a frame-like structure that is used to support and distribute the weight of an upper portion of the umbrella as well as to enable the umbrella to be opened and closed as desired by the user. The frame-like structure of such umbrellas can take various forms, but often includes one more hubs connected with a plurality of movable structural members.

The interconnection between hubs and structural members, such as umbrella ribs, previously had been achieved in an inconvenient way that was not adapted for rapid or low-cost assembly. In general, such prior interconnections were achieved in manufacturing by assembling a hub with a large number of pins and fasteners and coupling the ribs one by one to the hub with these pins and fasteners prior to full assembly of the hub. This process was extremely labor-intensive, costly, and could not be achieved quickly to provide suitable assembly times. This process also involved a large number of subcomponents, which could be difficult to manage in a supply chain, as well as in the assembly process itself.

SUMMARY OF THE INVENTION

An aspect of at least one of the embodiments disclosed herein is the realization that the connection devices used in the assembly of shade structures, such as pavilions and umbrellas, can be improved to provide a more secure, quicker, and more reliable connection. Such devices can use fewer parts and be easier to manufacture than those devices of the prior art. Such improved connections can be particularly advantageous for large shade structures which can sometimes be unwieldy.

According to another aspect of at least one embodiment disclosed herein is the realization that prior art umbrella hubs include an excessive amount of individual components. For example, individual pins are often individually placed into a portion of the hub before portions of the hub are carefully assembled. This tedious manufacturing can be costly and frustrating. Therefore, embodiments disclosed herein seek to remedy this deficiency by providing a hub assembly that uses a reduced number of parts. Accordingly, the time and cost required for manufacturing the hub can be greatly decreased.

Another aspect of at least one of the embodiments disclosed herein is the realization that while some devices to expedite assembly have been suggested, such devices have been inadequate, for example lacking the ability to bear a full range of operational loads, which can be much higher than the weight of the components of the shade structure, particularly in windy conditions. As such, the members of a frame of a shade structure should be quickly, securely, and firmly interconnected so that the frame can properly support not only the weight of the various structural members and the canopy, but also the stresses and other forces that are common or possible during the use of such structures.

In one embodiment, an umbrella hub is provided that includes a hub body with an upper portion and a lower portion. The hub body extends between an outer periphery and a central aperture configured to receive an umbrella pole. The upper portion defines a lower region and a plurality of recesses disposed about an outer periphery of the upper portion. The lower portion defines an upper region and a plurality of slots. The slots are disposed generally about an outer periphery of the lower portion. The lower portion is connectable to the upper portion. The lower portion also comprises a support surface extending between the outer periphery and the slots. At least one of the upper and lower hub portions defines an interior recess. The hub also includes a first engagement section and a second engagement section disposed immediately adjacent to the first engagement section. The first and second engagement sections are formed by the slots and the recesses of the lower and upper hub portions. The first and second engagement sections each are configured to receive an end portion of an umbrella structural member. The hub also includes a locking component disposed at least partially within the interior recess of the at least one of the upper and lower hub portions when the upper hub portion is connected with the lower hub portion. The locking component comprises a ring member enclosed within the hub body and disposed about the central aperture, a first flange, and a second flange. The first flange extends outward from the ring member. The first flange has an aperture configured to receive a pin of an umbrella structural member. The aperture is disposed on a first side of one of the first engagement section. The second flange extends outward from the ring member. The second flange has an aperture configured to receive a pin of an umbrella structural member. The second flange is disposed on a second side of the first engagement section opposite the first flange. At least one of the first and second flanges is configured to be deflected when the umbrella structural member is being moved into the engagement section toward the central aperture of the hub and pins of the rib or strut contact the flanges.

Simultaneous deflection of two flanges of the locking component can be provided upon insertion of an umbrella structural member into the engagement sections. In this way, quick and efficient simultaneous locking of the pins (or other rotation members) in the locking component can be provided.

In another embodiment, an umbrella hub is provided that includes a hub body, a locking device, and a plurality of slots. The hub body extends between an outer periphery and a central aperture and is configured to receive an umbrella pole. The locking device is housed within the hub body and has lateral surfaces with apertures formed therethrough opening to an internal space in the hub body. The slots are disposed about the outer periphery of the hub body. The slots are defined in part by opposing lateral surfaces of the locking device. Radial outer portions of the locking device are deflectable upon assembly to permit rotation members of umbrella structural members with a lateral extent greater than the width of the engagement section to be inserted from the side of the hub.

In some embodiments, the hub also comprises a loading zone disposed adjacent to the outer periphery, the loading zone comprising a generally horizontal surface for resting a pivot pin of an umbrella structural member and a deflectable surface radially inward of the horizontal surface, the deflectable surface and the horizontal surface providing a pathway for engaging the umbrella structural member with the pivot zone. The pathway for engaging the umbrella structural member with the pivot zone can be provided in that the horizontal surface is at the same elevation as an aperture formed in a wall of the loading zone. In this way, direct radial and horizontal insertion of the umbrella structural member into the rib slots causes engagement of the umbrella structural member with the hub.

In another embodiment, an umbrella assembly is provided that includes a hub body and a plurality of umbrella structural members. The hub body has a plurality of projections and a plurality of rib slots disposed between projections about an outer portion of the hub. A loading zone extends generally horizontally from the outer portion of the hub into the rib slots. The hub body also includes a plurality of apertures disposed in, and in some embodiments entirely through, sidewall surfaces of the slots. One umbrella structural member is disposed in each of the slots. The umbrella structural members include transversely extending pins (or other rotation member). The ends of the pins project through the sidewall apertures into the projections. The pins are retained in and able to pivot in the apertures.

In some embodiments, forces or loads from the structural members (e.g., pins of the ribs or struts) to the hub are born directly by a wall of a locking component and by a portion of the hub, e.g., by a portion of one of the flanges of the locking component and by an upward projection of the lower hub portion. By providing the direct load to the lower hub portion, the total load on the locking component can be reduced. This can make the locking component more robust and long lasting and/or enable the use of more materials that have less maximum load carrying capacity before failure to form this component.

In some embodiments, a portion of the loading zone is advantageously formed by a removable component that is deflectable in an area between the outer periphery and the apertures. In some embodiments, another portion of the removable component forms opposed sidewalls of the rib slots.

BRIEF DESCRIPTION OF THE DRAWINGS

The abovementioned and other features of the inventions disclosed herein are described below with reference to the drawings of the preferred embodiments. The illustrated embodiments are intended to illustrate, but not to limit the inventions. The drawings contain the following figures.

DETAILED DESCRIPTION OF THE PREFERRED EMBODIMENT

In accordance with embodiments described herein, there are provided various configurations of a hub and hub assembly that can be used with an umbrella support structure, such as an umbrella or pavilion, to facilitate the rapid and secure fastening of structural ribs with a hub or other rib of the structure. As described in greater detail herein, the hub and hub assembly can incorporate various features such that a secure connection with a structure, such as a mounting member of a hub of an umbrella, can be obtained. Additional details and features of related umbrella rib connectors and assemblies are illustrated and described in Applicant's U.S. Pat. No. 7,703,464, issued Apr. 27, 2010, entitled QUICK CONNECTOR FOR SHADE STRUCTURE, and in Applicant's U.S. Pat. No. 7,891,367, issued Feb. 22, 2011, entitled QUICK CONNECTOR HUB FOR SHADE STRUCTURE the entirety of the contents of both of which are incorporated herein by reference.

In some embodiments, the hub can be uniquely configured in a manner that reduces the cost for manufacture and assembly. For example, the hub can be made of as few as two parts, such as two halves of the hub that interconnect and attach to each other by the use of fastening means, such as screws, bolts, adhesives, or interlocking or pressure-fit elements on either of the parts of the hub. Further, the hub can be configured to include additional parts other than two halves. Such additional parts may serve to increase the functionality or otherwise enhance the physical characteristics of the hub. For example, the hub can include locking devices that facilitate the secure interconnection of the hub with a given umbrella rib. Exemplary embodiments of the same are provided herein to illustrate some of these principles.

The hub assembly can comprise a hub and an end of an umbrella rib. The hub of the assembly can be configured in any of the ways or combinations of the ways described herein to ensure that the umbrella rib is quickly and securely attached thereto while permitting relative rotational movement of the rib. Accordingly, the rib can be configured to include a structure on an end thereof such that the end of the rib can be connected with the hub.

Figure 1:
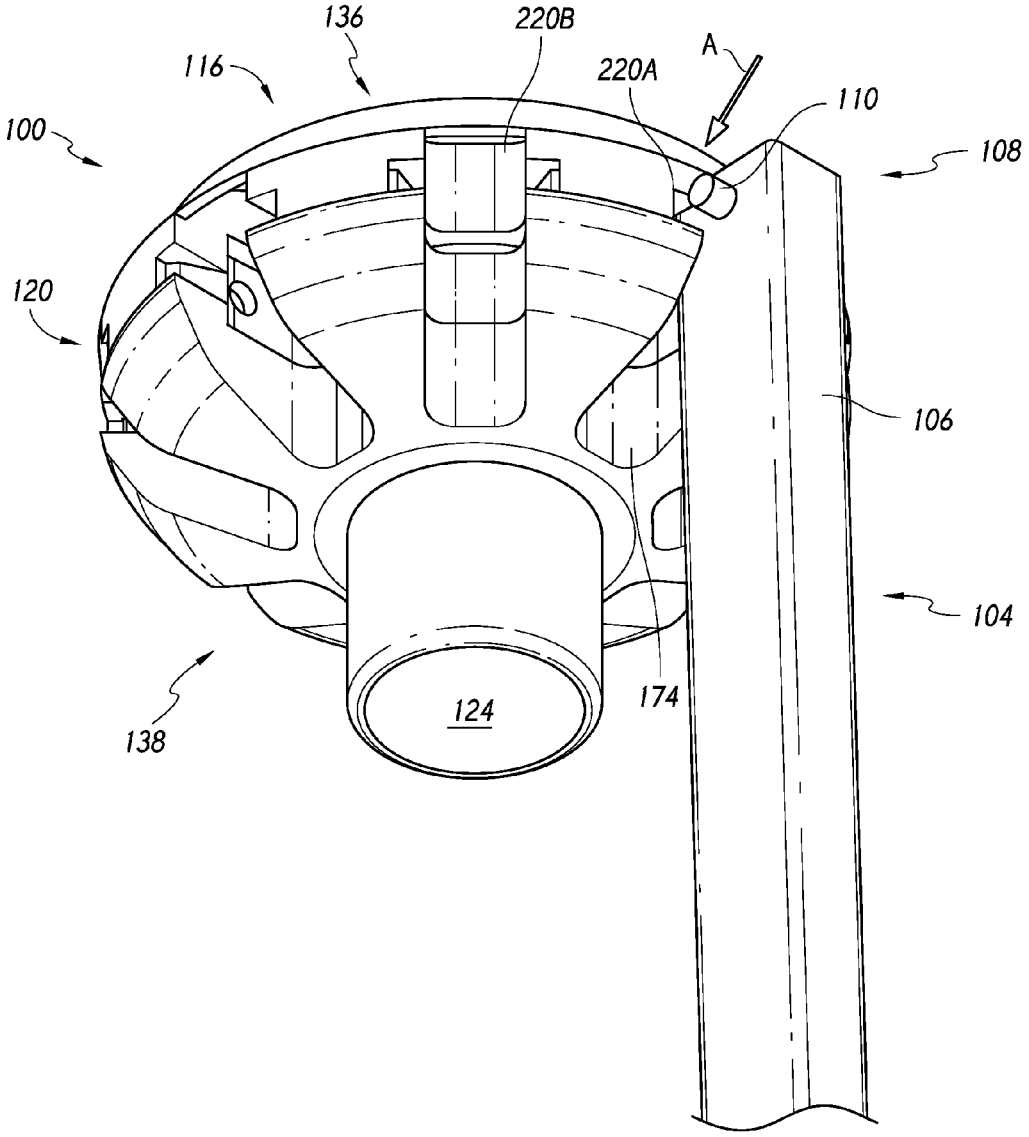
FIG. 1 is a perspective view of a hub assembly and umbrella rib, according to one embodiment.

FIG. 1 shows an umbrella hub 100 and an umbrella rib 104. An arrow A shows a direction of motion of the umbrella rib 104 into the hub 100 during an assembly step, discussed further below. The hub 100 and the rib 104 are configured for rapid and convenient assembly, including by an automated assembly process. The illustrated embodiments are focused on ribs and an upper hub of an umbrella assembly. However, the structures herein can be generically applied to any hub of an umbrella including a lower hub that may be fixed or may move up and down in use, e.g., along an umbrella pole. The hub 100 can be configured as a moving hub, e.g., as a runner.

In various umbrella assemblies, the rib 104 is disposed immediately beneath a shade structure, which can include a fabric cover or canopy (not shown). The rib 104 can be configured as an elongate member 106 with an inner end 108 and an outer end (not shown). The canopy will be draped over an upper surface of the rib 104 and will be coupled with the rib at least at or adjacent to the outer end of the rib. The outer end is disposed away from the hub 100 and the umbrella pole with which the hub is coupled when the umbrella assembly is open. The rib 104 pivots such that the outer end moves down to be adjacent to the umbrella pole beneath the hub 100 when the umbrella assembly is closed. The inner end 108 of the rib 104 has a rotation member 110 that is configured to engage the hub 100 when the rib 104 and hub 100 are coupled together. The rotation member 110 enables the above-noted pivoting of the rib 104 between the open and closed configurations. The rotation member 110 can include a substantially rigid pin that has sufficient length to extend into a hollow recess in hub 100 as discussed below. The pin can be a locating pin as discussed below. The pin can be arranged to extend generally parallel to the upper surface of the rib 104, e.g., through apertures on lateral sides thereof. The pin preferably has a circular periphery when viewed from its end and/or in transverse cross-section.

The hub 100 can includes a hub body 116 that extends between an outer periphery 120 and a central aperture 124. The central aperture 124 is configured to receive an umbrella pole (not shown). The hub body 116 comprises an upper portion 136 and a lower portion 138. The upper and lower portions 136, 138 are fastened together and house therein a locking component 140. The locking component 140 is configured to engage features of the umbrella rib 104 in a manner to secure the rib in place within the hub 100. For example, locking component 140 can receive lateral ends of the rotation member 110 and can prevent the rotation member 110 and the rib 104 from inadvertently coming out of the hub 100.

Figure 6:
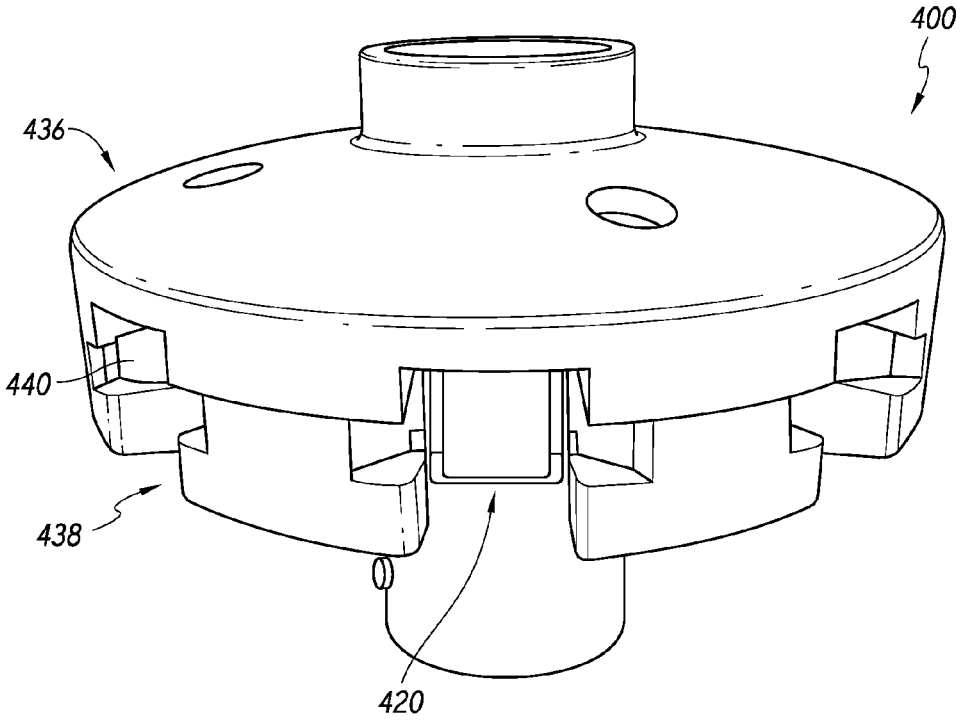
FIG. 6 is a top perspective view of another embodiment of a hub configured for rapid side-loading assembly.

In some embodiments, the locking component 140 is a continuous member that is configured to receive and retain the rotation members 110 of each of a plurality of ribs 104 of an umbrella. The locking component 140 can be a unitary member that acts as a hub for the interconnection of all of the ribs of an umbrella. The upper and lower portion 136, 138 can be considered housings for the locking component 140 which performs the function of capturing and retaining the rotation members 110 of the ribs 104. The locking component 440 of the embodiment of FIG. 6 has features that enhance the secure rib-capturing function of the locking component, as discussed further below.

Figure 4:
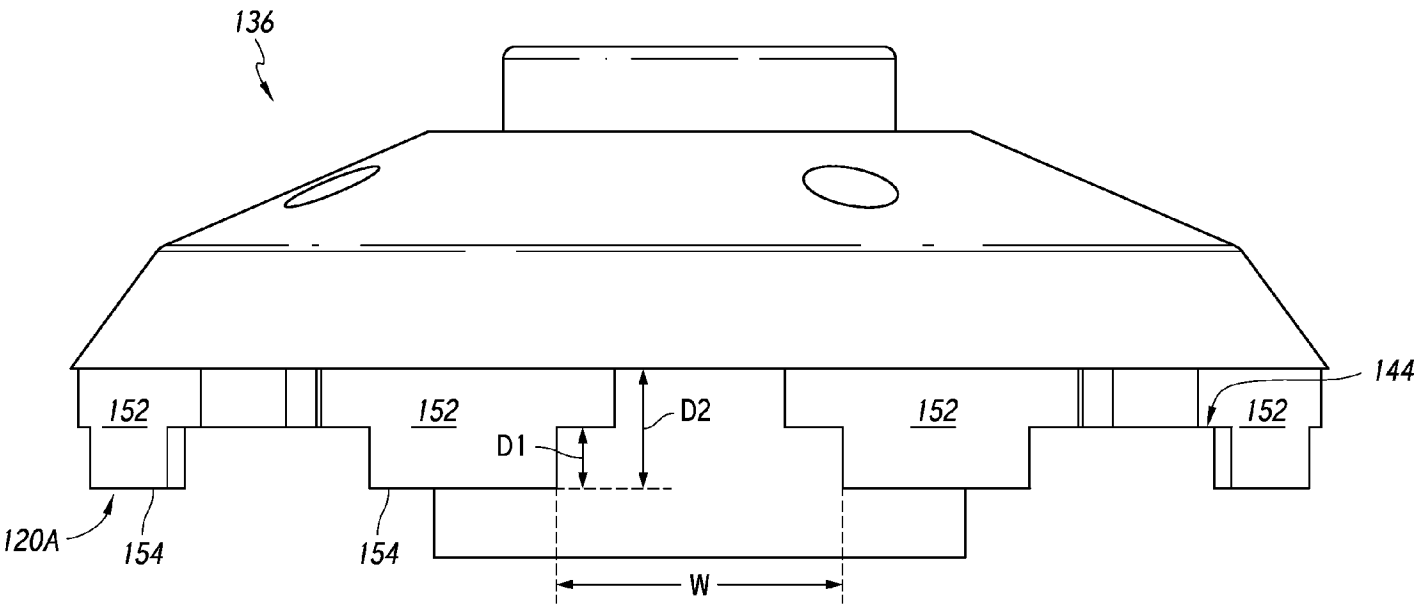
FIG. 4 is a plan view of a second hub portion that combines with the first hub portion to retain the locking component of FIG. 2.

The upper portion 136 has a lower region 142 that partly defines a plurality of recesses 144. The recesses 144 are disposed about an outer periphery 120A of the upper portion 136. The outer periphery 120A has a peripheral surface 152 that extends about the outer periphery 120A to partially enclose a space within the hub 100. The peripheral surface 152 is configured such that a lower edge 154 thereof abuts an upper edge of the lower portion 138 of the hub 100. FIG. 4 shows that the recesses 144 can have a stepped configuration, e.g., having a first dimension D1 and a second dimension D2 transverse to the lower region 142. The first and second dimensions D1, D2 extend from the lower edge 154 to adjacent first and second upper portions of the recess 144 in the stepped embodiments. As discussed further below, the dimension D1 is such that the rotation member 110 can easily slide into the hub 100 at the recess 144. The width W of the recess 144 at the outer periphery 120A is larger than the transverse length of the rotation member 110 such that the rotation member can easily slide into the hub 100 at the recess.

As discussed further below, the width W of the recess 144 can be smaller at locations inward of the outer periphery 120A that at or adjacent to the peripheral surface 152. In one embodiment, the width W varies, e.g., decreases between the peripheral surface 152 and the portion of the hub 100 configured to receive and retain an umbrella pole. In one embodiment, the walls defining the width W are portions of the locking component 140. The walls defining the recess can be substantially fixed or can be deflectable in various embodiments. If a fixed wall embodiment, the rotation member 110 is configured to deflect into the rib. In a deflectable wall embodiment, the walls defining the width W are deflected by the rotation member 110 as the inner end 108 of the rib 104 is slid into the hub 100.

In some embodiments, the area in which the inner end 108 of the rib is received is formed in part by the upper portion 136, in part by the locking component 140, and in part by the lower portion 138 of the hub 100 as discussed below. As discussed further below, lateral surfaces of the locking component 140 are disposed adjacent to the stepped features of the upper portion 136. The lateral surfaces can be angled to decrease the width W of the space inward of the recess 144, between the direction from the peripheral surface 152 and an inner zone of the hub 100.

The lower portion 138 defines an upper region 170 and a plurality of slots 174. The slots 174 are disposed generally about an outer periphery 120B of the lower portion 138. The lower portion 138 is configured to be connected to the upper portion 136 by way of a plurality of screw holes formed on one or both of the upper and lower portions 136, 138. A peripheral surface of the lower portion 138 can have upper edges 178 to abut the lower edges 154 of the upper portion 136. The mating edges 154, 178 and the configuration of the upper and lower portions 136, 138 as well as the configuration of the locking component 140 cause the locking component to be mostly shrouded within the hub 100 and generally hidden at the outer periphery 120. Lateral surfaces of the locking component 140 are exposed between the slots and recesses 174, 144 such that they may receive and retain the rotation members 110.

Figure 2:
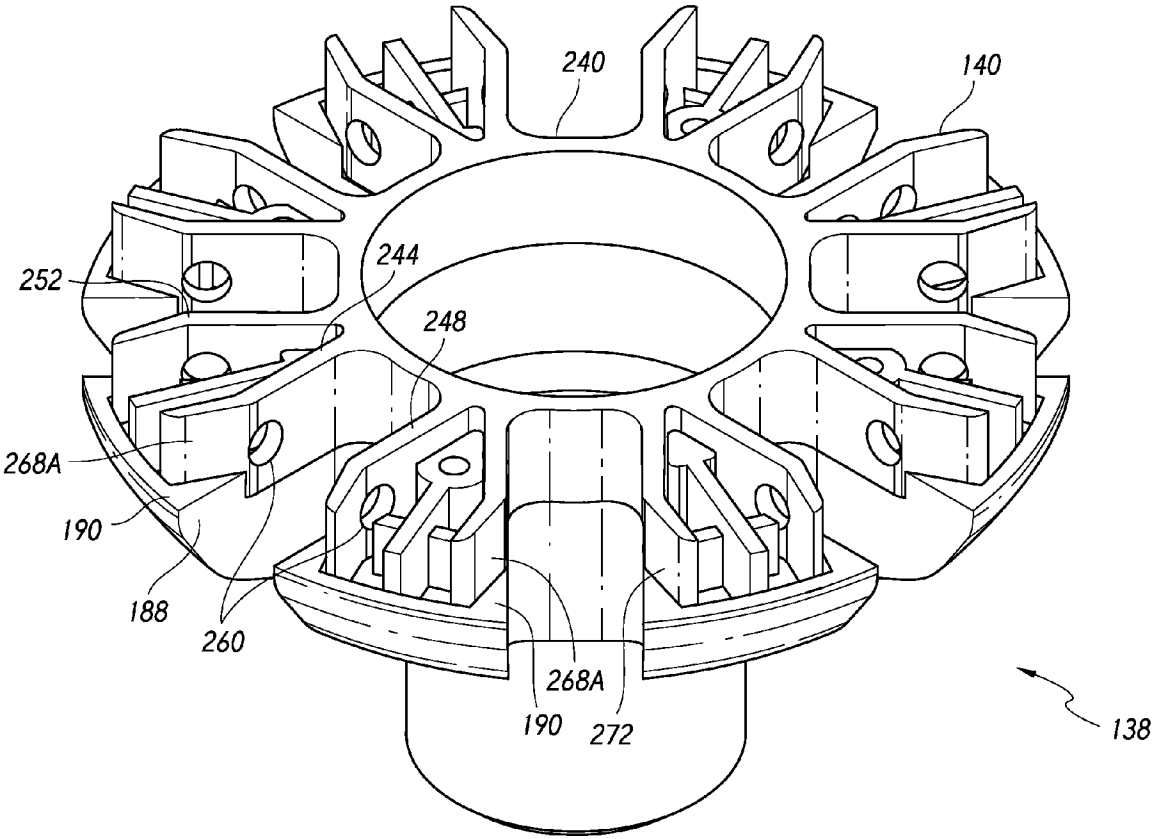
FIG. 2 is a perspective view of a subassembly of a hub assembly, showing a locking component received in a first hub portion.
Figure 3:
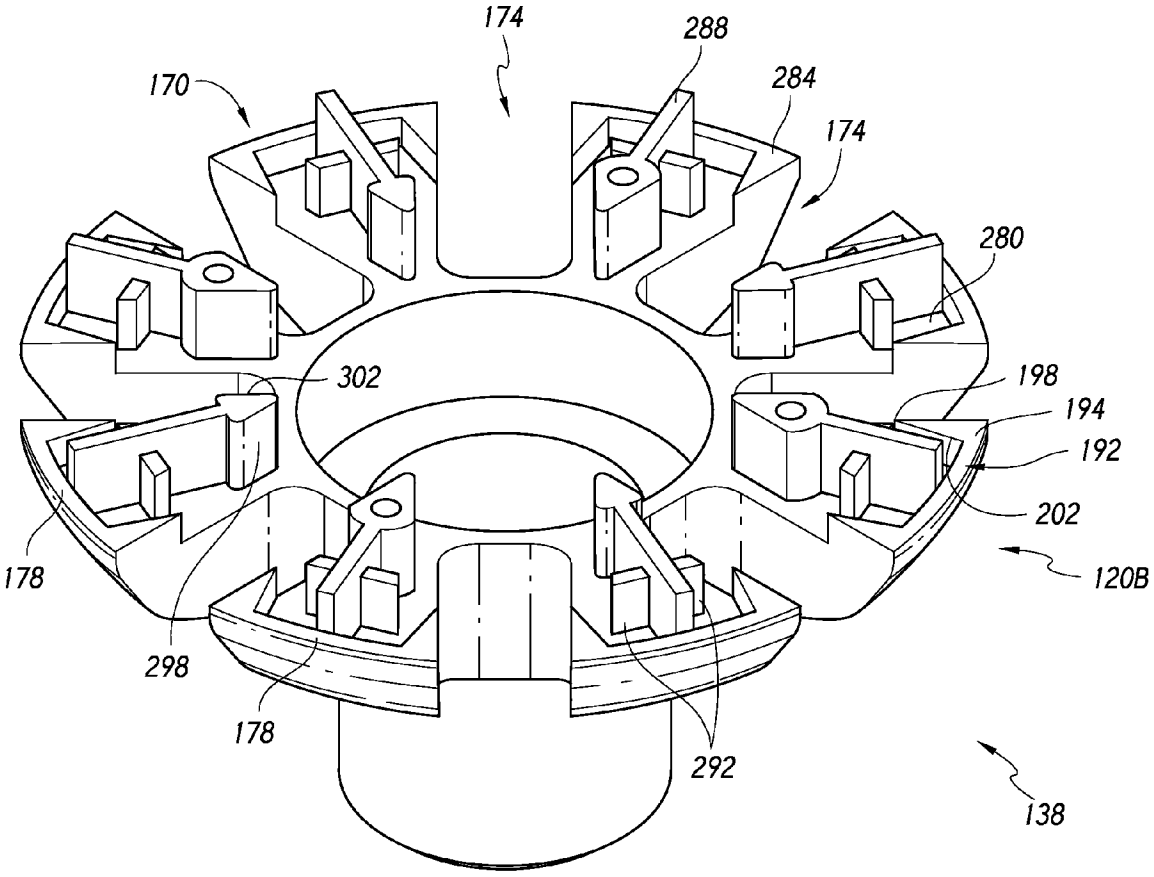
FIG. 3 shows the first hub portion, into which the locking component is received in FIG. 2.

A support structure, which can be a surface 190 extends between the outer periphery 120B and the slots 174. The support surface 190 extends into a space beneath the recesses 144. FIG. 2 shows that in one embodiment the support surface 190 is disposed adjacent to the slots 174. The support surface 190 extends from a lateral edge 188 of the slots 174 circumferentially toward and, in some case, up to the locking component 140. FIG. 3 shows that the support surface 190 can be raised relative to other nearby surface of the lower portion 138. The raised portion including the support surface 190 can extend between two adjacent slots 174 forming a bight 192 into which an outer portion of the locking components 140 is received.

The support surface 190 can include a generally radially directed projection that extends inwardly from a base 194 at the outer periphery 120B to a peak 198 adjacent to the lateral edge 188 of the slots 174. The circumferential width of the support surface 190 at the base 194 can be substantially equal to the distance that the rotation member 110 extends laterally from the rib 104. The support surface 190 can be bounded by a lateral surface 202 that extends from the base 194 toward the slots 174.

The support surface 190 provides a guiding or loading zone for sliding the rotation member 110 into place. In particular, as shown in FIG. 2 support surfaces are disposed on both sides of each of the slots 174. As the rib 104 is placed adjacent to the outer periphery of the hub 120 the rotation member 110 can be brought to rest on the support surfaces. Because the dimension W is greater than the distance between the ends of the rotation member 110, the rotation member can enter the recess without resistance. Further advancement of the rib 104 into the slot 174 and recess 144 cause the rib to be secured in place in the hub 100 as discussed further below.

FIGS. 2 and 3 show the manner in which the locking component 140 is supported and secured between the upper and lower components 136, 138. The hub 100 includes an interior recess located between the upper and lower portions 136, 138. The interior recess is a space or cavity in which the locking component can be disposed. When so disposed, the locking component 140 is hidden when the hub is viewed along a radius from the outer periphery. FIG. 1 shows that the recess has a height sufficient to enclose the locking component 140 therein while permitting the edges 154, 178 to abut each other when the hub 100 is assembled. FIG. 2 shows that approximately one-third of the locking component 140 is received in the upper region 170 of the lower portion 138. The raised portion including the support surface 190 and the edge 178 are raised by about this one-third dimension relative to a base or recessed zone of the upper region 170. Similarly, the lower region 142 of the upper portion 136 extends downwardly by an amount about two-thirds the height of the locking component 140. This arrangement positions a retention structure of the locking component 140 to be at an elevation above the support surface 190 and at an elevation above the lower edge 154 of the upper portion 136. This arrangement is advantageous in that the rotation member 110 can slide directly laterally from the support surface 190 to the retention structure.

A plurality of engagement sections 220 shown in FIG. 1 is formed by the combination of the slots 174 and the recesses 144. The engagement sections 220 are configured to receive end portions of the ribs 104, which extend generally downward therefrom. In other embodiments, the hub 100 can be configured as a runner and the rib 104 as a strut extending upwardly from the runner.

The locking component 140 is disposed at least partially within the interior recess of at least one of the upper and lower hub portions 136, 138 when the upper hub portion is connected with the lower hub portion. The locking component 140 includes a ring member 240 enclosed within the hub body 116. The ring member 240 can include sleeve with a circular inner periphery and a spoke like outer configuration. The locking component 140 is substantially taller along the pole axis P than the rotation member 110 in order to be able to receive the rotation member in a mid-section of the spoke-like outer portion. The circular inner periphery can form a portion of a continuous inner boundary of the hub 100, which boundary can be configured to receive the umbrella pole. In some embodiments, one or both of the upper and lower portions 136, 138 at least partially enclose the circular inner periphery of the locking component 140. In other embodiments, the inner circumference of the ring member 240 is substantially larger than the outer circumference of the pole member.

In one embodiment, a plurality of flanges is provided with each of the flanges extending outwardly from the ring member 240. The flanges can include a first flange 244, a second flange 248 and a third flange 252. The first flange 244 preferably extends outward from the ring member 240 and has an aperture 260 formed therein. The aperture 260 is or can form a portion of a retention structure. The aperture 260 is configured to receive the rotation member 110, e.g., a pin. FIG. 2 shows that the first flange 244 is disposed on a first side of one of a first engagement section 220A.

Figure 5:
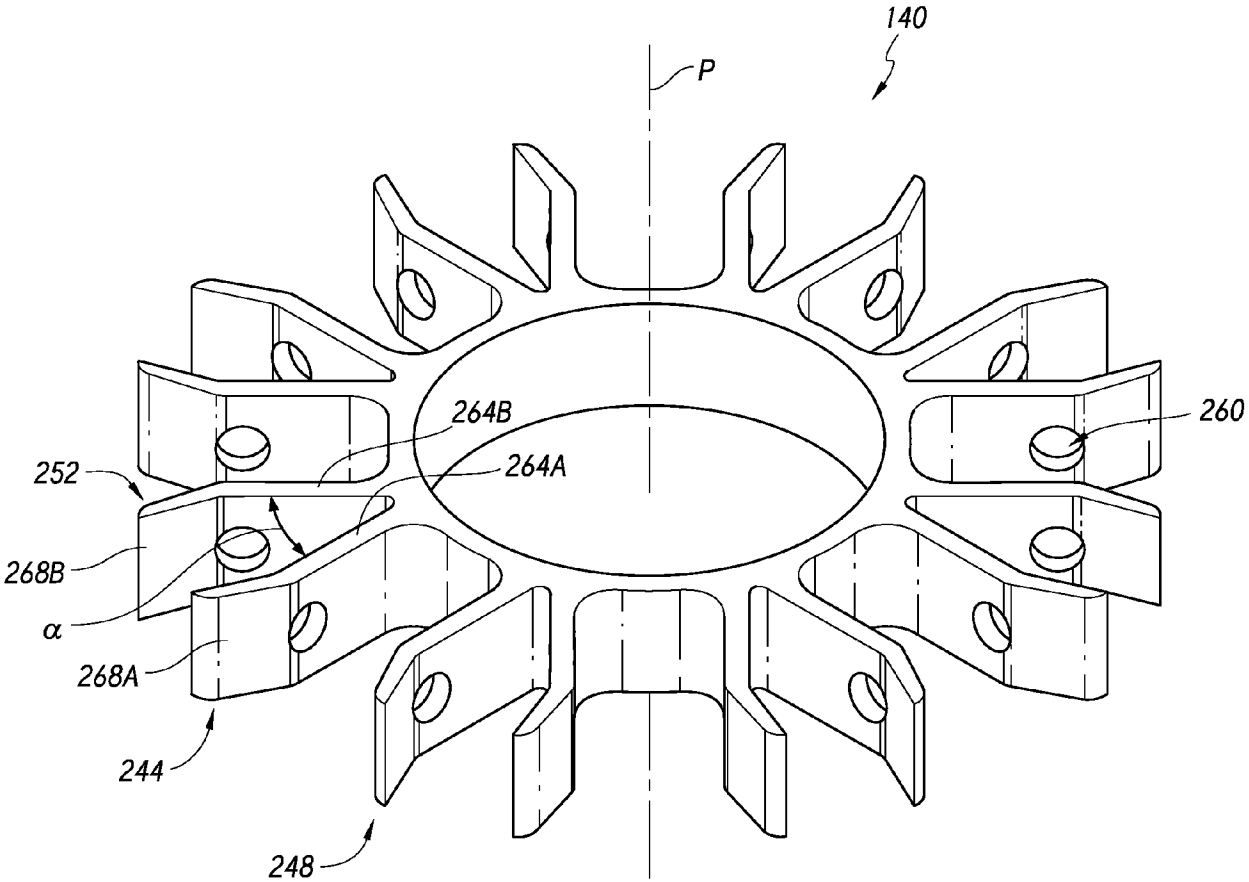
FIG. 5 is a perspective view of the locking component of FIG. 2.

Among the many advantages of the embodiments herein are the rib retaining functions of the locking component 140. In this regard, the locking component 140 can act as rib retention component. The rib retention component or rib retainer is separable from the upper portion 136 and lower portion 138 of the hub 100. The aperture 260 is surrounded by a continuous surface of the locking component 140. The continuous surface prevents movement of the pin and rib 104 radially out of the hub. The continuous surface also prevents movement parallel to the direction P (see FIG. 5), e.g., either upward or downward. The continuous surface can comprise a cylindrical surface extending through the wall of the flange in which the aperture 260 is disposed. The continuous surface can be the lateral face of the flange that forms a part of the engagement sections, as discussed elsewhere herein. More specifically, the lateral face of the flanges extends upward and downward, radially inward and radially outward from the aperture 260. These surfaces prevent the pin from being dislodged in multiple, e.g., all directions. Because the locking component 140 retains the pins and ribs 104, the component 140 and the upper and lower portions 136, 138 can be optimized for their purposes. The locking component 140 can be made of a high strength plastic material so that the forces applied to the flanges at the apertures 260 can be borne without deformation or dislodgement. The upper and lower portions 136, 138 can be made of a material that is durable in harsh environments, such as the southwestern United States where sun exposure can degrade certain plastics.

The structure of the hub 100 and the locking components 140 are such that a robust and convenient quick connect hub construction is provided. As noted above, the locking component 140 is elongated along the axis P such that the rotation members 110 can be retained directly in the flanges 244, 248, 252. The material extending above and below the aperture 260 provide a bracing effect to the flanges 244, 248, 252. As a result, typical inward and outward forces during an expected duty cycle will not result in breakage of the flanges. More particularly the portions 268A, 268B (discussed below) can resist breakage due to outward force due to this bracing effect. The hubs disclosed herein are advantageous in providing unique combinations of quick assemble capability with a robust, strong design. These structures improve over designs where deflectable members may be used to block egress of a rib but that are not well braced or supported and may be subject to breakage due to concentration of stress in small lands of material.

The second flange 248 preferably extends outward from the ring member 240. The second flange 248 preferably has an aperture 260 configured to receive the rotation member 110. The second flange 248 is disposed on a second side of the first engagement section 220A opposite the first flange 244. When one of the ribs 104 is fully inserted into the slot 174, the rotation member 110 extends laterally on both sides of the rib and into apertures 260 in the first and second flanges 244, 248.

The third flange 252 preferably extending outward from the ring member 240. The third flange 252 preferably has an aperture 260 configured to receive the rotation member 110. The third flange 252 is preferably disposed on a side of the second engagement section 220B adjacent to the first flange 244. The group of three flanges 244, 248, 252 repeat around the perimeter of the ring member 240.

The first and third flanges 244, 252 preferably have first elongate generally radially extending portions 264A, 264B that extend outward of the ring member 240. The first portions 264A, 264B extend along directions such that outer portions thereof are farther apart from each other circumferentially than inner portions thereof. In some embodiments, an angle $\alpha$ is formed between the first portions 264A, 264B. The first and third flanges 244, 252 preferably also have second portions 268A, 268B that extend generally radially. The second portions 268A, 268B can be formed such that they extend along directions non-parallel directions. The outer portions of the second portions 268A, 268B preferably are closer to each other circumferentially than inner portions of the second portions 268A, 268B. This configuration provides a V shape that is inwardly sloped at the open end of the V. The inwardly sloped aspects of the V preferably extend along the lateral surface 202 of the support surface 190.

The first and second flanges 244, 248 provide a convenient engagement and retention structure in combination with the support surface 190 and the second portion 268A of the first flange 244 and a corresponding second portion 272 of the second flange 248. In a preassembled state, the rib 104 is placed adjacent to the support surface 190. The rotation member 110 is disposed on the support surface 190. Further inward radial motion of the rotation member 110 causes the rotation member 110 to be brought into contact with the second portions 268A, 272. The second portion 268A, 272 are ramped surfaces from the perspective of the rib 104 that create progressively more force between the second portion 268A, 272 and the rotation member 110 and/or deflection of the second portion 268A, 272 by further advancement. In one embodiment, the flanges 244, 248 are rigid and are not deflectable such that as the rib 104 and the rotation member 110 move inwardly in the engagement sections 220 the rotation members 110 move into the body of the rib 104. Once the rib passes the boundary between the second and first portions 268A, 272 the rotation member 110 un-retracts or extends outward into the apertures 260.

In one embodiment, the rotation members 110 are fixed in the lateral direction. At least one of the flanges 244, 248, 252 are deflectable within the hub. In a preassembled state, the rib 104 is placed adjacent to the support surface 190. The rotation member 110 is disposed on or over the support surface 190. Further radially inward motion of the rotation member 110 causes the rotation member to be brought into contact with the second portions 268A, 272, which are ramped from the perspective of the rotation members 110. The force applied by the rotation members 110 causes deflection of the flange(s) 248, 252 or the flanges 244, 248. As the rib 104 is advanced between the flanges 248, 252 the rotation member 110 deflects the second portions 268A, 272 away from the slot 174 in which the rib is positioned. Once the rib 104 passes the boundary between the second and first portions 268A, 264A the rotation member 110 enters the apertures 260 which permits the deflected flange 244, 248 to return to the un-deflected state (as shown in FIG. 2). In this state, the surface of the aperture 260 that is farthest from the ring member 240 blocks egress of the rotation member 110 from the aperture and thus the rib 104 from the engagement section 220.

FIGS. 2 and 3 show that in various embodiments, the upper region 170 of the lower portion 138 has a base surface 280 and a plurality of raised sections. The base surface 280 is configured to receive the locking component 140. For example, a contiguous surface is provided within the base surface 280 that permits the ring member 240 and the flanges 244, 248, 252 to lie flat on top of the lower portion 138 as shown in FIG. 2. A first raised section 284 is provided adjacent the outer periphery 120B and extends contiguously to support surfaces 190 disposed on lateral sides of two adjacent slots 174. This structure forms the bight 192 into which adjacent first and third flanges 244, 252 are received.

A second raised section 288 is provided on the base surface 280. The section 288 can be disposed substantially entirely on one, a plurality or all of the projections of the lower portion 138 that separates adjacent slots 174 from each other. The raised section 288 preferably provides a support disposed between the ring member 240 and the outer periphery 120B of the lower portion 138. The raised section 288 also preferably provides a support disposed between adjacent engagements sections 220.

The raised section 288 can have structures to provide supportive functions of retaining the rib 104 in the hub 100. In some embodiments, the raised section 288 has one or more, e.g., two, projections 292 to resist the pulling out of the ribs 104. The first and second projections 292 extend toward the first and third flanges 244, 252. FIG. 2 shows that the projections 292 are located outwardly of the radial location of the apertures 260 of the flanges 244, 248, 252 and inwardly of the outer periphery 120B of the lower portion 138. The projections 292 are configured in some embodiments to prevent umbrella structural member (e.g., rib or strut) from being inadvertently dislodged from the umbrella hub 100. In some cases, the projections 292 reduce the play of the rib 104 in the engagement section 220. For example, the distance between the outer face of the rotation member 110 and the nearest portion of the projections 292 can be less than the distance between the rib 104 and the lateral wall of the engagement section 220 so that the ribs do not move substantially side-to-side within the engagement sections. For example, in the embodiment where the rotation member 110 is depressed into the body of the rib 104 the release of the depressing force permits the pins to move back out of the body of the rib and when fully extended the rotation member is radially inward of and overlaps with the projection 292. Thus any outward movement of the rotation member 110 would bring the rotation member into contact with the projection 292. The angle and length of the second portions 268A, 268B, 272 enable sufficient inward depression of the rotation member 110 because the outermost region of the second portions 268A, 268B overlaps the lateral extent of the projections 292.

In various embodiments the portions 268A, 268B, 272 of the flanges 244, 248 deflect as the rib 104 is being inserted into the engagement sections 220.

The raised portion 288 preferably also has one or more lateral surfaces to limit deflection of the first portions 264A, 264B of the flanges 244, 248. For example the raised portion 288 can be a support comprising a first lateral surface 298 disposed behind the first flange 244 to minimize movement of the first flange toward the third flange 252 and away from the first engagement section 220A. The raised portion 288 preferably also comprises a second lateral surface 302 disposed behind the third flange 252 to minimize movement of the third flange toward the first flange and away from the second engagement section 220B. FIG. 3 shows that the first and second lateral surfaces 298, 302 can be disposed at an angle that is substantially the same as the angle $\alpha$ defined between generally radially extending portions of the first and third flanges 244, 252 (see FIG. 5). The surfaces 298, 302 are disposed within and close to where the first portions 264A, 264B of the flanges 244, 252. In one embodiment, the surfaces 298, 302 are angled to match a deflected angle between facing surfaces of the first portions 264A, 264B of the flanges 244, 252 such that when the first portions are deflected to the maximum extent desired they lie flat on the support surfaces 298, 302. Thus, the angle between the surfaces 298, 302 may be less than the angle $\alpha$ by a small amount, e.g., by 5-10 degrees. Thus the surfaces 298, 302 limit the amount of deflection permitted of in the flanges 244, 248, 252.

FIG. 3 shows that the lower portion 138 can be provided with a plurality of apertures for receiving fasteners to couple the upper and lower portions 136, 138 together. These apertures may be configured to receive bolts, screws or other fasteners. In one embodiment, the mount holes are disposed between the first and second surfaces 298, 302 on alternating raised portions 288.

FIGS. 6-11 illustrate a hub 400, which is one of many possible variations of the hub 100. The hub 400 is similar to and incorporates the description of the hub 100 except where differently described below. The hub 400 includes a locking component 440. Structures and functions similar to those of the raised portion 288 are integrated into the locking component 440 in some embodiments. The locking component 440 including these structures can be placed on an upper region 470 of a lower portion 438 of the hub 400 during assembly and held in place between an upper portion 436 and the lower portion 438.

In one variant the locking component 440 includes flanges 444, 448, 452. Flanges 444, 448 are disposed to be on opposed sides of an engagement section 420 of the hub 400. Second portions 468, 472 of opposing flanges are displaceable by a pin or other rotation member 110 to enable a structural member such as the rib 104 to enter the engagement section 420. When the rib 104 is disposed in the engagement section 420, the rotation member 110 is disposed through an aperture A in a wall of the flanges 444, 448. The locking component 440 defines a space 450 between opposing flanges of adjacent engagement sections 420. The space 450 receives an end of the rotation member 110. In one embodiment, an abutment 480 is integrated into the locking component 440. A gap G is defined between the abutment 480 and the flange 444. The gap G is just larger than the length of the rotation member 110 to minimize play in the position of the rib 104 relative to the hub 440, as discussed above.

A plurality of abutments 480 can be disposed in the space 450, e.g., symmetrically about a radius of the locking component 440 extending midway between the flanges 444, 452. In one embodiment, a brace 482 is provided in the space 480 between the flanges 444, 452. The brace 482 can be any structure that extends between, e.g., continuously between, the flanges 444, 452. The brace 482 can be configured as an annulus with an inner diameter that is sized to receive a screw or similar fastener that is advance through the upper and lower portions 436, 438.

Figure 7:
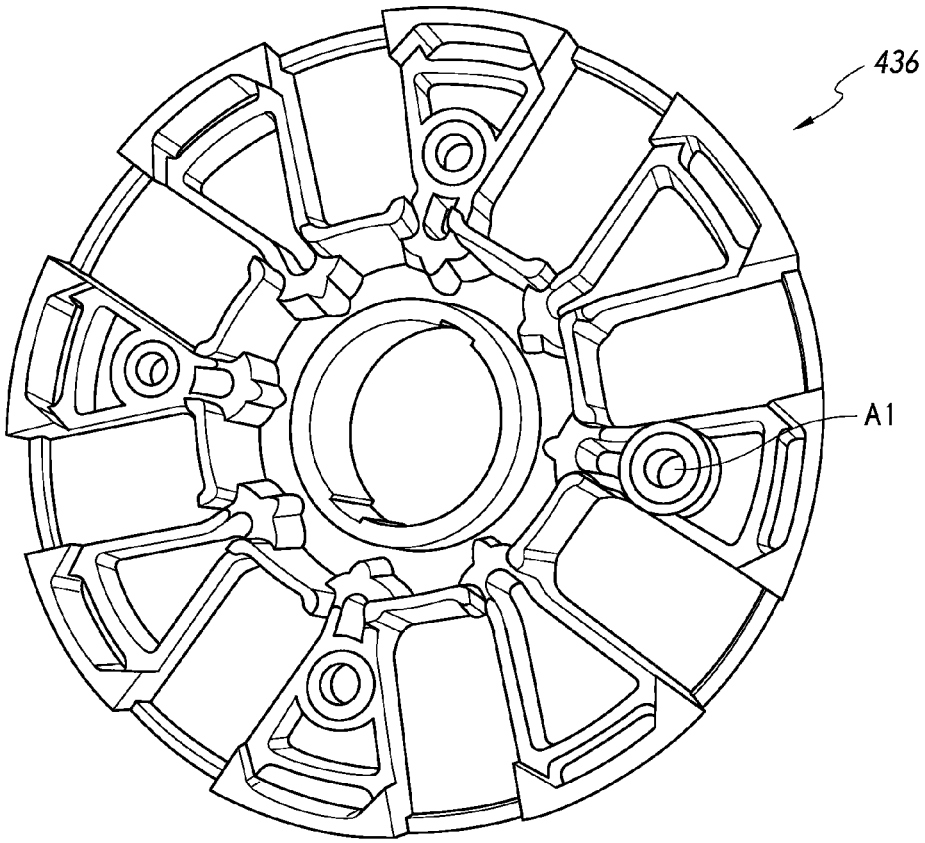
FIG. 7 is a bottom view of an upper portion of the hub embodiment of FIG. 6.
Figure 8:
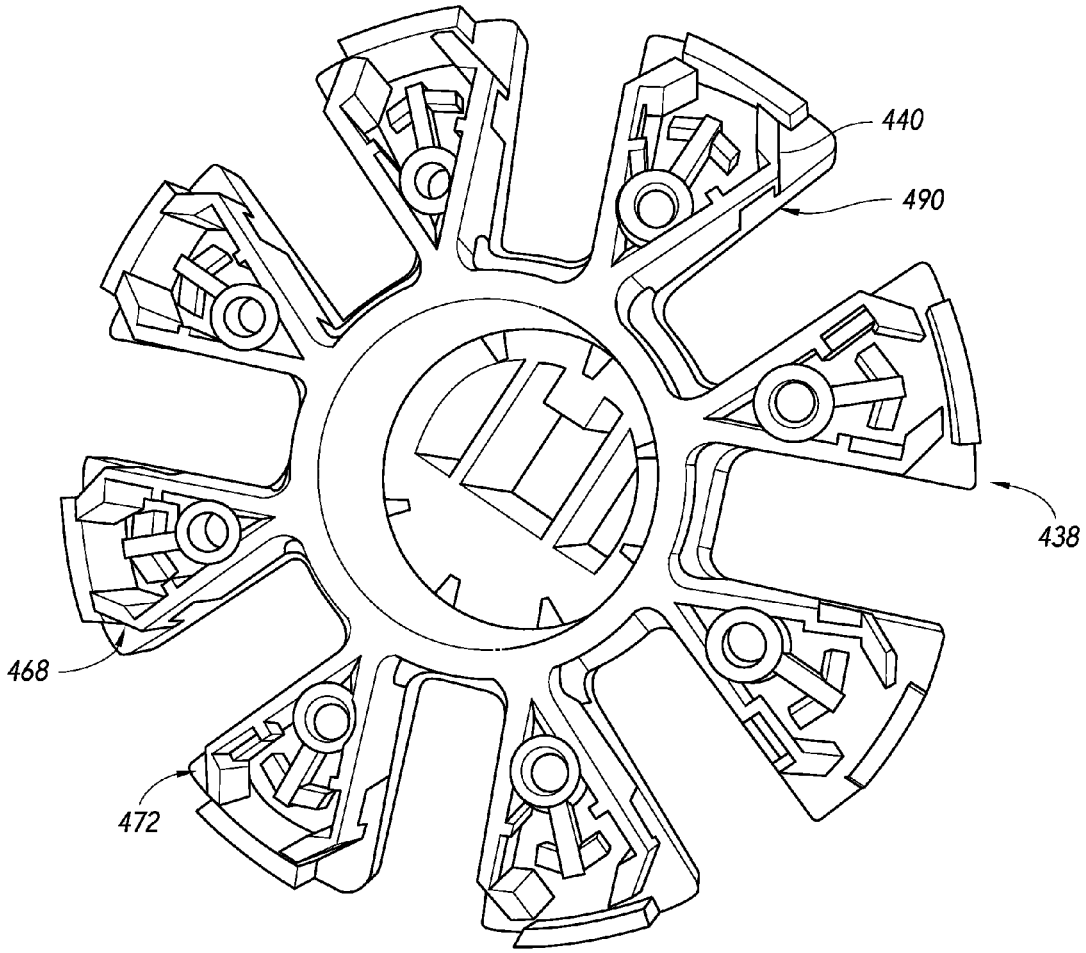
FIG. 8 is a perspective view of a subassembly of the hub embodiment of FIG. 6, showing a locking component received in a lower hub portion.
Figure 9:
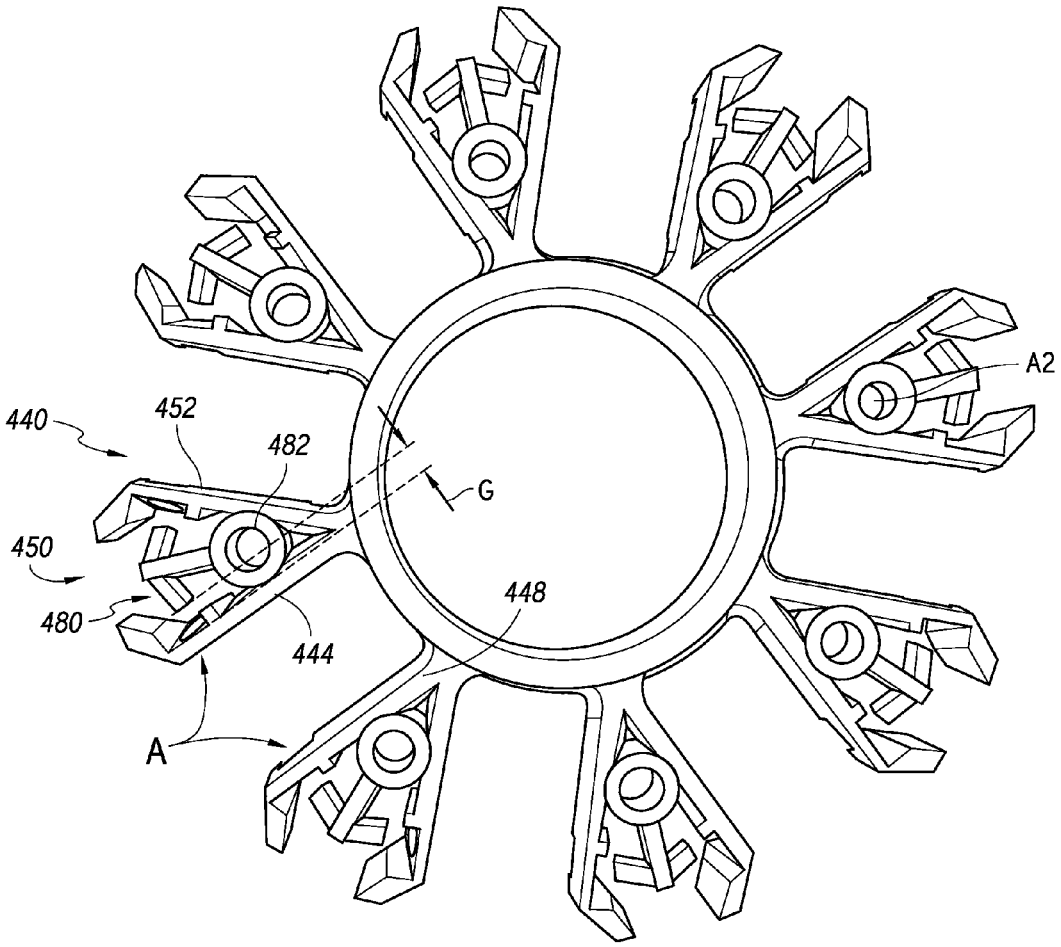
FIG. 9 is a top view of a locking component of the embodiment of FIG. 6.
Figure 11:
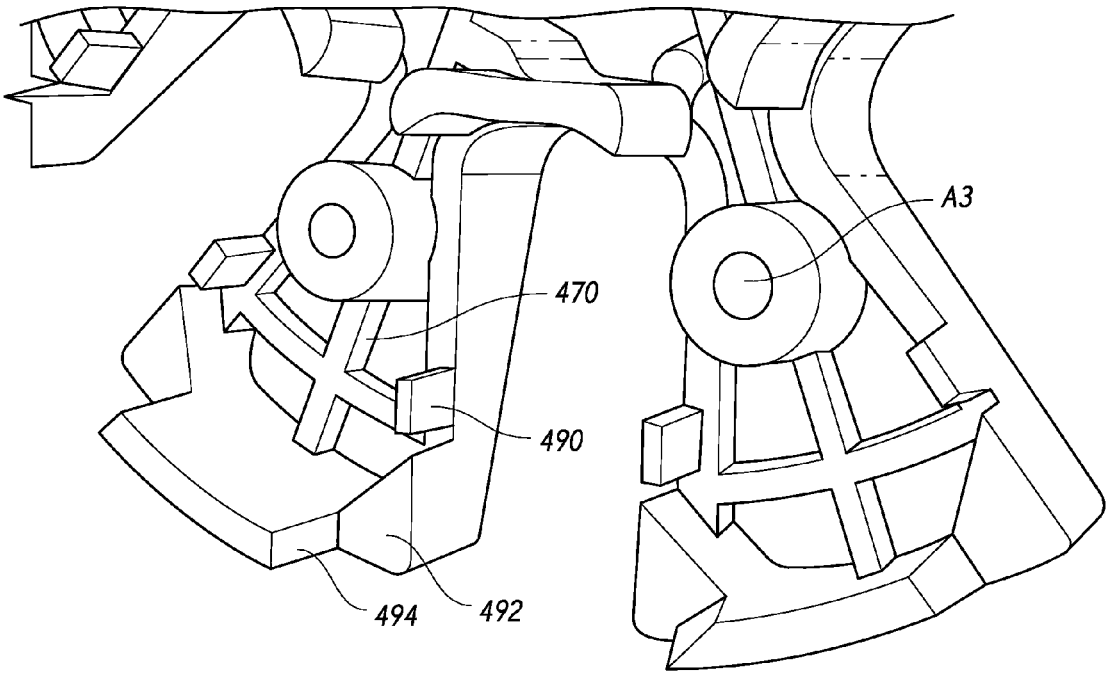
FIG. 11 is an enlarged view of a lower hub portion in the embodiment of FIG. 6.

FIGS. 7, 8, and 11 illustrate that each of the upper and lower portions 436, 438 and the locking components 440 have apertures for fasteners. As such, these components can be directly fastened together by at a plurality of points by fasteners. In particular, a plurality of through-holes or recesses A1 is provided on the upper portion 436, a plurality of through-holes A2 is provided on the locking component 440, and a plurality of through-holes or recesses A3 is provided on the lower portion 438. A single fastener can be disposed through aligned through-holes A1, A2, A3. This provides an advantage of making the hub 400 of a very solid feel, at least in that the locking components is not free to move around within the spaced defined between the upper and lower portions 436, 438. As such, the hub 400 is a highly unified assembly.

The brace 482 and the raised portion 288 can serve similar functions. In one embodiment, the abutment 480 projects radially outward from an outer portion of the brace 482 to radial location of the apertures A in the flanges 444, 452. The structure of the brace 482 substantially prevents the inner portions of the flanges 444, 452 from flexing while permitting sufficient flexing of the outer portion of the flanges 444, 452 so that the rotation members 110 of the rib 104 can deflect the outer portions, as discussed above.

Figure 10:
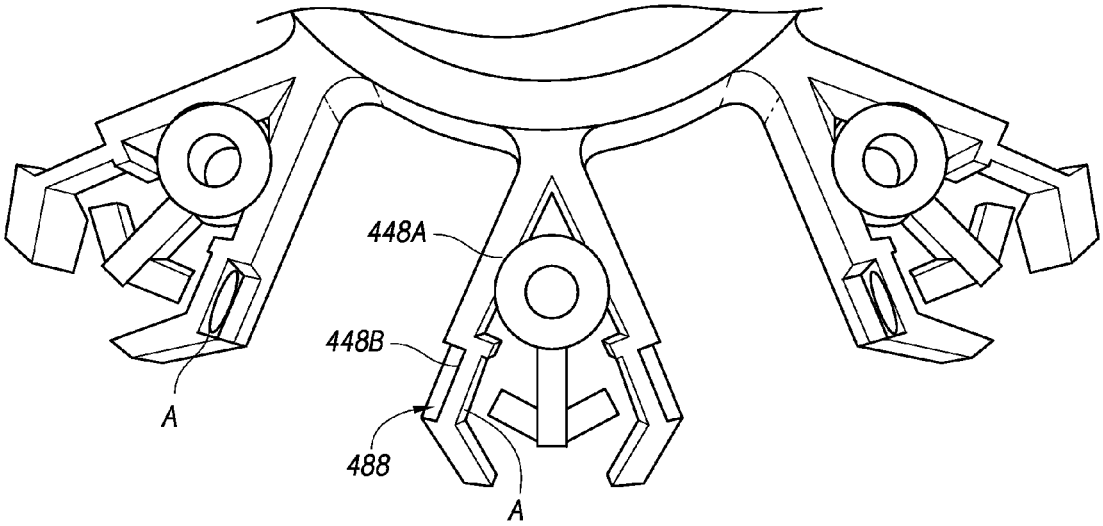
FIG. 10 is an enlarged bottom view of a locking component of the embodiment of FIG. 6.

FIGS. 10 and 11 shows in more detail how the locking component 440 integrates with the lower portion 438. Each of the flanges 444, 448, 452 has a recess 488 that extends from a lower surface of the locking component 440 toward the upper surface thereof and disposed on the sides of the flange facing the engagement sections 420. The recess 488 can comprise a thinned wall section of adjacent to the second (outer most) portions 468, 472 of the flanges. As shown in FIG. 10, the recess 488 can correspond to an off-set section of the flange where an outer portion 444A of the flange is located such that a projection of an inner portion 444B is between the outer portion 444A and the nearest engagement sections 420.

FIGS. 8 and 11 show a support structure 490 that can be formed on the lower portion 438 and project up to a location that corresponds to the position of the recess 488 when the locking component 440 is in the lower portion 438. The support structure 490 is disposed to support a portion of the load of the rotation member 110 so that directly applied load from the rotation member is shared between locking component and the lower portion 438 of the hub 400. The load applied by the rotation member 110 to the outer portion 444B of the flange 444 (and corresponding portion of the other flanges) is transferred to the lower portion 438 as well. Dividing the directly applied force reduces the amount of the force applied to the locking component 440. This can reduce wear and extend the life of the hub 440 compared to one without such force dividing capability.

The off-set configuration of the outer portion 444B enables the support structure to be received in the recess 488 so that the outer wall of the assembled lower portion 438 and locking component 440 provides a flush lateral wall of an engagement section 420, as shown in FIG. 8. The force dividing benefit is thus provided without complicating the path of insertion of the pin or rotation member 110 as the rib 104 is inserted into the engagement section 420.

The hub 400 also differs from the hub 100 in that at least a majority the locking component 440 is housed in the lower portion 438. As such, the stepped profile of the upper portion discussed above in connection with FIG. 4 is provided on the lower portion. This enables the lower portion 438 to provide a loading zone that includes a support surface 492 and a side wall 494. These structures guide the rotation member 110 as the rib 104 is initially being loaded into the hub 440. This arrangement can provide a continuous structure adjacent to where the rotation member 110 is advanced into the hub 400 which can minimize mismatch of separable structures at this zone.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. An umbrella hub comprising:

a hub body extending between an outer periphery and a central aperture configured to receive an umbrella pole, the hub body comprising:

an upper portion defining a lower region and a plurality of recesses disposed about an outer periphery of the upper portion; and a lower portion defining an upper region and a plurality of slots, the slots being disposed generally about an outer periphery of the lower portion, the lower portion being connectable to the upper portion, the lower portion also comprising a support surface extending between the outer periphery and the slots;

at least one of the upper and lower hub portions defining an interior recess;

a first engagement section and a second engagement section disposed immediately adjacent to the first engagement section, each of the first and second engagement sections at least partially bounded by one of the slots of the lower portion and one of the recesses of the upper portion, the first and second engagement sections each being configured to receive an end portion of an umbrella structural member; and a locking component comprising:

a ring member enclosed within the hub body and disposed about the central aperture; and a first flange extending outward from the ring member, the first flange having a first aperture and a first side portion disposed along a first side of and exposed to the first engagement section, the first side portion having the first aperture extending there-through, the first aperture being configured to receive a first end portion of a pin of an umbrella structural member; and a second flange extending outward from the ring member, the second flange having a second aperture and a second side portion disposed along a second side of and exposed to the first engagement section opposite the first side portion, the second side portion having the second aperture extending there-through, the second aperture being configured to receive second end portion of the pin of the umbrella structural member;

wherein at least one of the first and second flanges is configured to be deflected away from the other of the first and second flanges when the umbrella structural member is being moved into the first engagement section toward the central aperture of the hub and the pin of the umbrella structural member contacts the locking component.

2. The umbrella hub of claim 1, the lower portion further comprising:

a surface configured to receive the locking component;

a support disposed between the ring member and the outer periphery of the lower portion and between the first and a third flanges disposed adjacent to the first flange in a zone between the first and second engagement sections.

3. The umbrella hub of claim 2, wherein the support comprises first and second projections extending toward the first and third flanges, the projections being disposed at the radial locations of the apertures of the flanges and configured to reduce the lateral movement of the umbrella structural member_within the engagement section of the umbrella hub.

4. The umbrella hub of claim 2, wherein the support comprises a first lateral portion disposed between the first flange and the third flange to minimize movement of the first flange toward the third flange and away from the first engagement section.

5. The umbrella hub of claim 4, wherein the support comprises a second lateral portion disposed between the third flange and the first flange to minimize movement of the third flange toward the first flange and away from the second engagement section.

6. The umbrella hub of claim 5, wherein the first and second lateral portions are surfaces disposed at an angle that is substantially the same as an angle defined between generally radially extending portions of the first and third flanges.

7. The umbrella hub of claim 5, wherein the first and second lateral portions are arcuate portions forming a continuous structure from the third flange to the first flange.

8. The umbrella hub of claim 1, wherein both of one of the first and second flanges are configured to be deflected when the umbrella structural member is being moved into the engagement section toward the central aperture of the hub and pins of the umbrella structural member contact the flanges.

9. An umbrella hub assembly comprising:

an umbrella structural member configured to support an umbrella shade member;

a rotation member coupled with the umbrella structural member, the rotation member extending between opposite ends, the ends being spaced apart by a first distance;

a hub body extending between an outer periphery and a central aperture configured to receive an umbrella pole;

a locking device housed within the hub body, the locking device having a first set of lateral surfaces with apertures formed therethrough, the apertures opening to an internal space in the hub body, the apertures of the lateral surfaces of the first set facing each other and being spaced apart by a second distance less than the first distance, the locking device having a second set of lateral surfaces coupled with and inclined away from outer portions of the lateral surfaces of the first set such that a third distance is provided between the second set of lateral surfaces, the third distance being greater than the first distance; and a slot extending radially inwardly from the outer periphery of the hub body, the slot defined in part by the first set of lateral surfaces of the locking device;

wherein at least a portion of at least one of the lateral surfaces of the second set of lateral surfaces of the locking device is deflectable to increase the third distance by an amount sufficient to permit the rotation, member of the umbrella structural member to be inserted from the periphery of the hub body.

10. The umbrella hub assembly of claim 9, wherein each of the lateral surfaces of the second set of lateral surfaces of the locking device includes a ramp structure extending from adjacent to the outer periphery toward a corresponding lateral surface of the first set of lateral surfaces.

11. The umbrella hub assembly of claim 10, wherein the locking device further comprising a flange disposed within the hub body, the flange comprising the one of the lateral surfaces of the first set of lateral surfaces and the ramp structure.

12. The umbrella hub assembly of claim 10, wherein a loading zone is disposed between a lower surface of an upper portion of the hub body and an upper surface of a lower portion of the hub body and between the outer periphery and the ramp structure.

13. The umbrella hub assembly of claim 12, wherein the locking device further comprises a ring member separate from and received between the upper and lower portions of the hub body, the ring member comprising an inner member comprising a continuous inner periphery and a plurality of flanges extending radially outward from the inner member, each of the flanges comprising the lateral surface and the ramp structure.

14. The umbrella hub assembly of claim 9, wherein the hub body houses a circumferential support disposed radially outwardly of the central aperture, such that the rotation member extends through the aperture in at least one of the first set of the lateral surfaces, the end of the rotation member is in adjacency with a surface of the circumferential support.

15. The umbrella hub assembly of claim 14, wherein the circumferential support comprises a radial support and first and second angled inner surfaces, the first and second angled inner surfaces abutting inner sides of adjacent flanges comprising the first and second sets of lateral surfaces, the circumferential support including first and second lateral projections extending from the radial support.

16. An umbrella assembly, comprising:

a hub body comprising a plurality of projections and a plurality of slots disposed between projections about an outer portion of the hub, a loading zone extending from the outer portion of the hub into one of the slots, and a plurality of lateral wall apertures disposed through continuous lateral walls of the slots, the lateral wall apertures disposed in a fixed position relative to the hub body; and a plurality of umbrella structural members, one umbrella structural member disposed in each of the slots, the umbrella structural members including transversely extending pins;

wherein ends of the transversely extending pins project through the lateral wall apertures into a cavity defined in part by the lateral walls, the pins being retained and able to pivot in the lateral wall apertures wherein the loading zone comprises a ramp surface on each side of the slot, wherein a circumferential distance between inner ends of the ramp surfaces is less than a distance between ends of the transversely extending in disposed in the slot; and wherein the ramp surface and the aperture on at least one side of the slot are formed on adjacent angled portions of a continuous member.

17. The umbrella assembly of claim 16, wherein the continuous member comprises a ring-shaped configuration.

18. The umbrella assembly of claim 17, wherein an upward projection of a lower portion of the hub extends up to the lateral wall apertures_and provides support for the pins of the umbrella structural member.

* * * * *

UNITED STATES PATENT AND TRADEMARK OFFICE

CERTIFICATE OF CORRECTION

PATENT NO. : 9,078,497 B2
APPLICATION NO. : 13/787601
DATED : July 14, 2015
INVENTOR(S) : Oliver Joen-an Ma It is certified that error appears in the above-identified patent and that said Letters Patent is hereby corrected as shown below:

In The Claims

In Column 13, Lines 52-53, In Claim 3, change "member_within" to --member within--.

In Column 14, Line 36, In Claim 9, change "rotation," to --rotation--.

In Column 16, Line 8, In Claim 16, change "in" to --pin--.

In Column 16, Line 17, In Claim 18, change "apertures_and" to --apertures and--.

Signed and Sealed this
Twenty-second Day of March, 2016

Michelle K. Lee

Michelle K. Lee
*Director of the United States Patent and Trademark Office*